United States Patent [19]

Johnson

[11] Patent Number: 4,841,947

[45] Date of Patent: Jun. 27, 1989

[54] LENS-LIKE RADIANT ENERGY TRANSMISSION CONTROL MEANS

[75] Inventor: Roger N. Johnson, Mercer Island, Wash.

[73] Assignee: Radiant Optics, Inc., Seattle, Wash.

[21] Appl. No.: 943

[22] Filed: Jul. 14, 1986

Related U.S. Application Data

[63] Continuation of Ser. No. 755,760, Jul. 18, 1985, abandoned, which is a continuation-in-part of Ser. No. 646,134, Aug. 31, 1984, abandoned.

[51] Int. Cl.[4] ..... F24C 3/04

[52] U.S. Cl. ..... 126/92 B; 362/279; 362/291

[58] Field of Search ..... 126/441, 449, 439, 92 B, 126/92 R; 350/503, 109, 129, 162.23; 431/210, 215, 328, 329; 362/279, 290, 291

[56] References Cited

U.S. PATENT DOCUMENTS

| | | | |
|---|---|---|---|
| 3,291,115 | 12/1966 | Forniti | 126/92 |
| 4,088,121 | 5/1978 | Lapeyre . | |
| 4,244,354 | 1/1981 | Williams . | |
| 4,356,813 | 11/1982 | Hoffman et al. . | |

OTHER PUBLICATIONS

Land, Michael F., "Animal Eyes with Mirror Optics", Scientific American magazine, Dec. 1978, pp. 126–134.

*Primary Examiner*—Larry Jones
*Attorney, Agent, or Firm*—Seed and Berry

[57] ABSTRACT

The control means (10) are interposed lens-like between the radiant energy source (6) and the area to be irradiated, and comprise a structure (18) of open ended cells (22) that are adapted to transmit the energy while imaging it reflectively on the area to be irradiated in more or less intensified form than the source alone would provide by direct transmission to the area, depending on the location of the source with respect to the structure and the focal point thereof.

29 Claims, 6 Drawing Sheets

Fig. 2
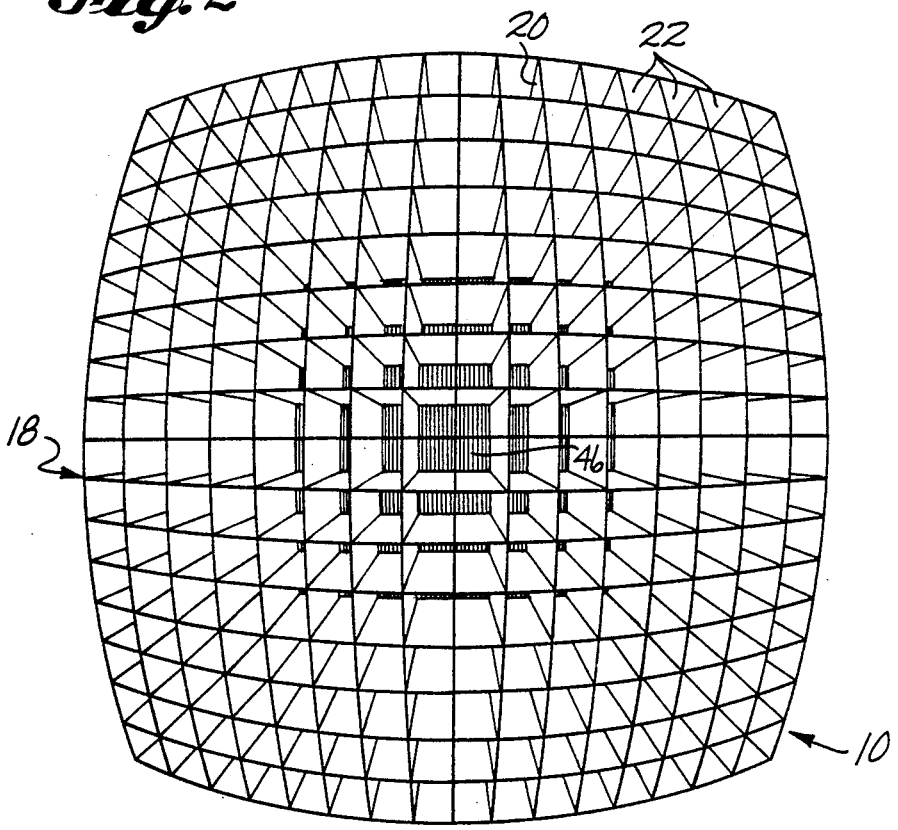
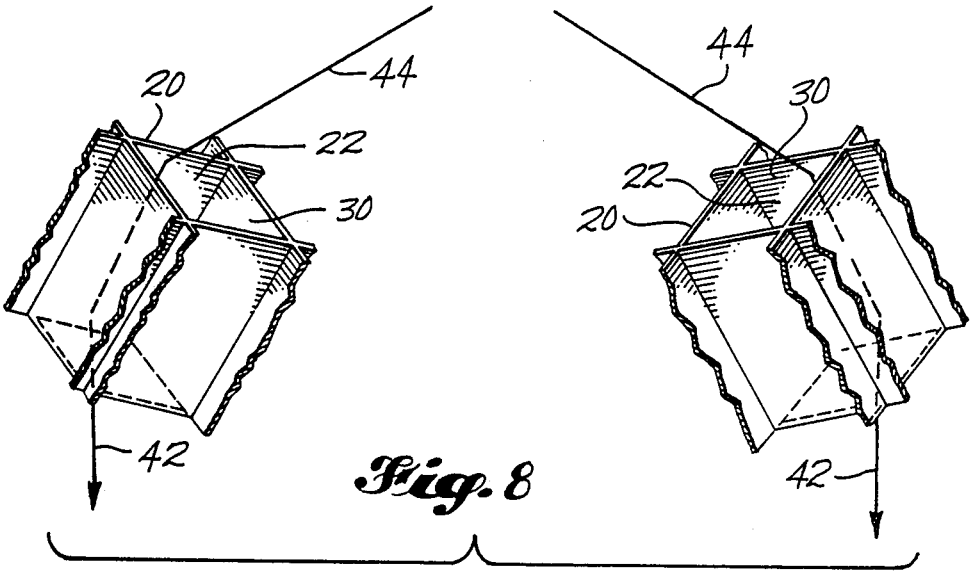
Fig. 8

Fig. 3
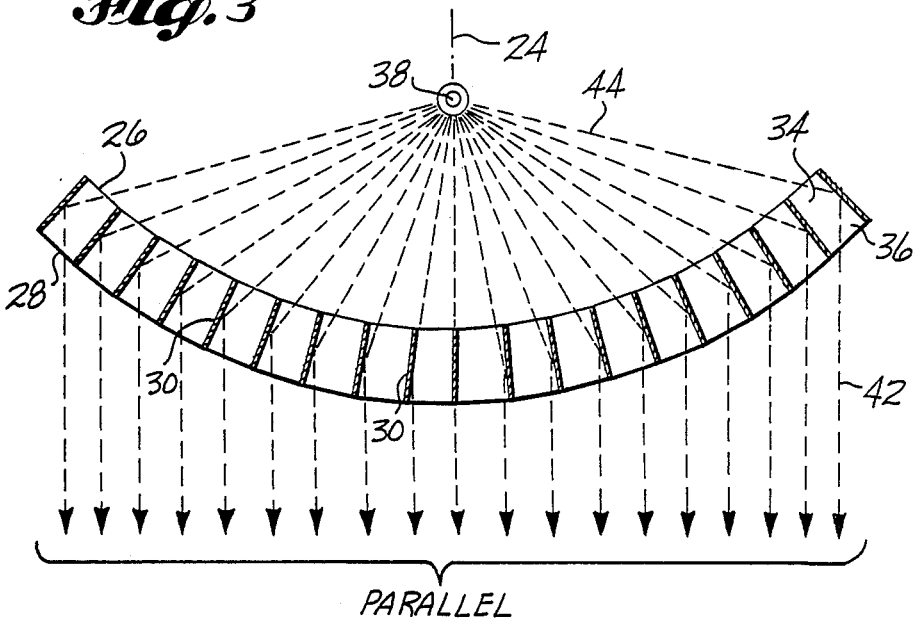
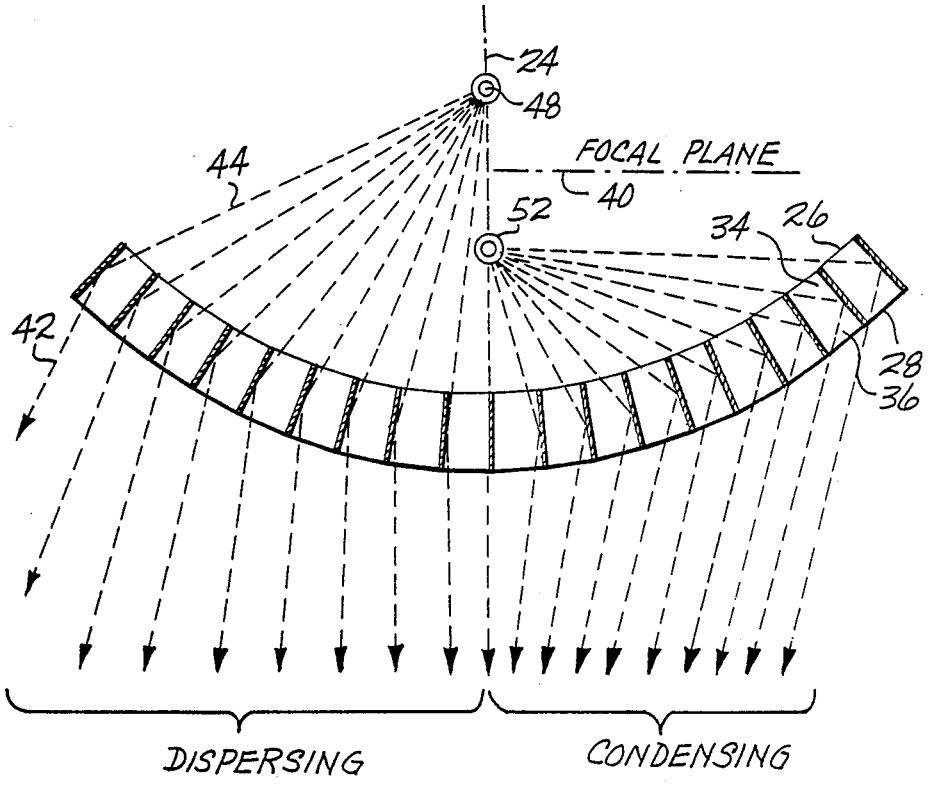
Fig. 4

LENS-LIKE RADIANT ENERGY TRANSMISSION CONTROL MEANS

CROSS-REFERENCES TO RELATED APPLICATIONS

This application is a continuation of U.S. patent application No. 755,760, filed July 18, 1985, now abandoned, which was a continuation-in-part application of U.S. patent application No. 646,134, filed Aug. 31, 1984, now abandoned.

DESCRIPTION

1. Technical Field

This invention relates to means for controlling the transmission of heat or other radiant energy, and in particular means of this nature which are interposed on the axis of transmission between the radiant energy source and the area to be irradiated, to operate as a lens. The control means can be put to many uses, and are operable to control the transmission of all forms or radiant energy, in all types of media, liquid, gaseous or otherwise. However, one of the primary uses of the control means is to control heat transmission, and therefore, for illustration purposes they will be described in that context, but for illustration purposes only.

2. Background Art

A gas fired infrared heater is often used as a high intensity overhead space heater for a work area, and is sometimes equipped with a refractive quartz lens as a means of imaging the heat in more intensified form on the area to be irradiated. The lens transmits perhaps only 40% of the heat directed at it, however, and can be subjected to only limited levels of heat before it will selfdestruct because of the absorption rate of the lens itself and/or the inability of the lens to dissipate the absorbed heat.

3. Disclosure of Invention

One object of the present invention is to provide radiant energy transmission control means which operate as a lens between the radiant energy source and the area to be irradiated, but image the energy on the area to be irradiated by reflection rather than refraction, so that they do not have the limitations which limit the usefulness of a refractive lens. Another object is to provide radiant energy transmission control means of this nature which have absorption/emissivity characteristics that enable them to transmit as much as 85% of the energy directed at the area to be irradiated. A further object is to provide control means of this nature which are apertured or grid-like in character so that the energy transmitted across the same, is transmitted in the same ambient medium—liquid, gaseous or otherwise—through which the energy is transmitted otherwise between the radiant energy sourch and the area to be irradiated. A still further object is to provide control means of this nature which may be impregnated with a medium that is different from the ambient transmission medium so that, if desired, a secondary effect, for example, a filtering and/or refractive effect, can be superposed on the primary imaging effect achieved by the control means. Still another object is to provide control means of this nature which can be modified so that they selectively reflect only certain frequencies of energy in any band of energy incident thereon. Other objects include the provision of control means of this nature which can be used in all ambient media—liquid, gaseous or otherwise—and which are operable to the same effect in each medium. Still further objects will become apparent from the description of the invention which follows hereafter.

These objects and advantages, and additional ones as well, are realized by certain radiant energy transmission control means of my invention which in use, are interposed on the axis of transmission between the radiant energy source and the area to be irradiated, to operate as a lens, and comprise a grid structure, the matrix of which defines an array of open ended cells that are juxtaposed to one another about the axis of transmission, and open to the opposing sides of the structure at the opposing axially oriented faces thereof. The individual cells of the array have reflective walls about the inner peripheries thereof, and are orthogonal in cross-section in planes perpendicular to those axes of the cells which extend in the general axial direction of the structure and outward through the open ends of the cells. Moreover, the latter mentioned axes of the cells are angularly oriented to the axis of transmission so that the structure has a focal point on the axis of transmission at one side thereof, and the cells are varied in length along the respective axes thereof, relative to the cross-sectional areas thereof, so that when the source is disposed at the focal point, the energy which is radiated into the adjacent open end portions of the cells from that point, undergoes reflection to and from the walls of the cells no more than twice before exiting from the cells at the opposing open ends thereof, and is reflected from the outer peripheral walls of the cells in the direction of the other side of the structure along parallels to the axis of transmission, at those points on the outer peripheral walls of the cells where the centermost cross-sectional planes of the cells, axially thereof, intersect the aforesaid outer peripheral walls. When the source is shifted along the axis of transmission to one side or the other of the focal point, however, the energy is imaged on the area to be irradiated in a more or less intensified form than the source alone would provide by direct transmission to the area, depending on the location of the source with respect to the focal point. Similarly, when the source is disposed on the opposite side of the structure from the focal point, that is, on the aforesaid other side thereof, then points of radiation on the source at the aforesaid parallels to the axis of transmission, are imaged at the focal point of the structure in accordance with the foregoing parameters, but in the opposite direction of transmission.

Preferably, the cells have substantially square cross-sections in the aforesaid cross-sectional planes thereof, and the cross-sections are substantially constant in area from one end of each cell to the other. However, in order to employ a structure, the matrix of which has a uniform thickness at the webbing thereof, it is often necessary to provide a slight axially inward taper to the cross-sectional area of the cells in the axial direction of the focal point from the aforesaid other side of the structure, or at least with respect to the cross-sectional area of the peripherally outwardly disposed cells of the array. Likewise, it may be necessary to make the cross-sections of the cells more rectangular as the cells are displaced peripherally outwardly from the axis of transmission.

The cells may be filled with the ambient medium about the structure, whether the medium is liquid, gaseous or otherwise; or the cells may be impregnated with a medium which is different than that surrounding the structure. For example, they may be filled with a medium that is refractive and/or absorptive of certain frequencis of the energy. Likewise, the webbing of the matrix and/or the walls of the cells may be adapted to selectively absorb certain frequencies of the energy while reflecting one or more others.

The faces of the structure may be planar or curved, and in certain presently preferred embodiments of the invention, the structure takes the form of a concavo-convexly faced panel of thin-webbed matrix material.

In some of the presently preferred embodiments of the invention, the cells have rectangular cross-sections in the aforesaid cross-sectional planes thereof, the longer dimensions of which are oriented along parallels to one plane of the axis of transmission so that the energy radiated from the aforesaid opposing open ends of the cells is splayed along a line of said one plane. In certain embodiments, moreover, the cells have opposing walls in the shorter dimensions thereof crosswise the aforesaid one plane of the axis of transmission, which are parallel to one another so that the radiated energy is splayed along a line of predetermined length.

BRIEF DESCRIPTION OF THE DRAWINGS

These features will be better understood by reference to accompanying drawings which illustrate two presently preferred modes of carrying out the invention when it is embodied in a panel used to control the heating of a work space in a shop.

In the drawings:

FIG. 2 is a bottom view of the overhead space heater along a central axis normal to the panel;

FIG. 3 is a generally schematic cross-sectional view of the panel in the axial plane thereof, and illustrating the heat focusing effects of the panel with respect to energy radiating from the focal point thereof;

FIG. 4 is a generally schematic cross-sectional view of the panel similar to that of FIG. 3, but illustrating heat focusing effects of the panel with respect to energy radiating from other points thereabove;

FIG. 8 is a part-perspective view of the matrix of the panel at one cell thereof and illustrating certain aspects of the heat focusing effects;

BEST MODES FOR CARRYING OUT THE INVENTION

Figure 1:
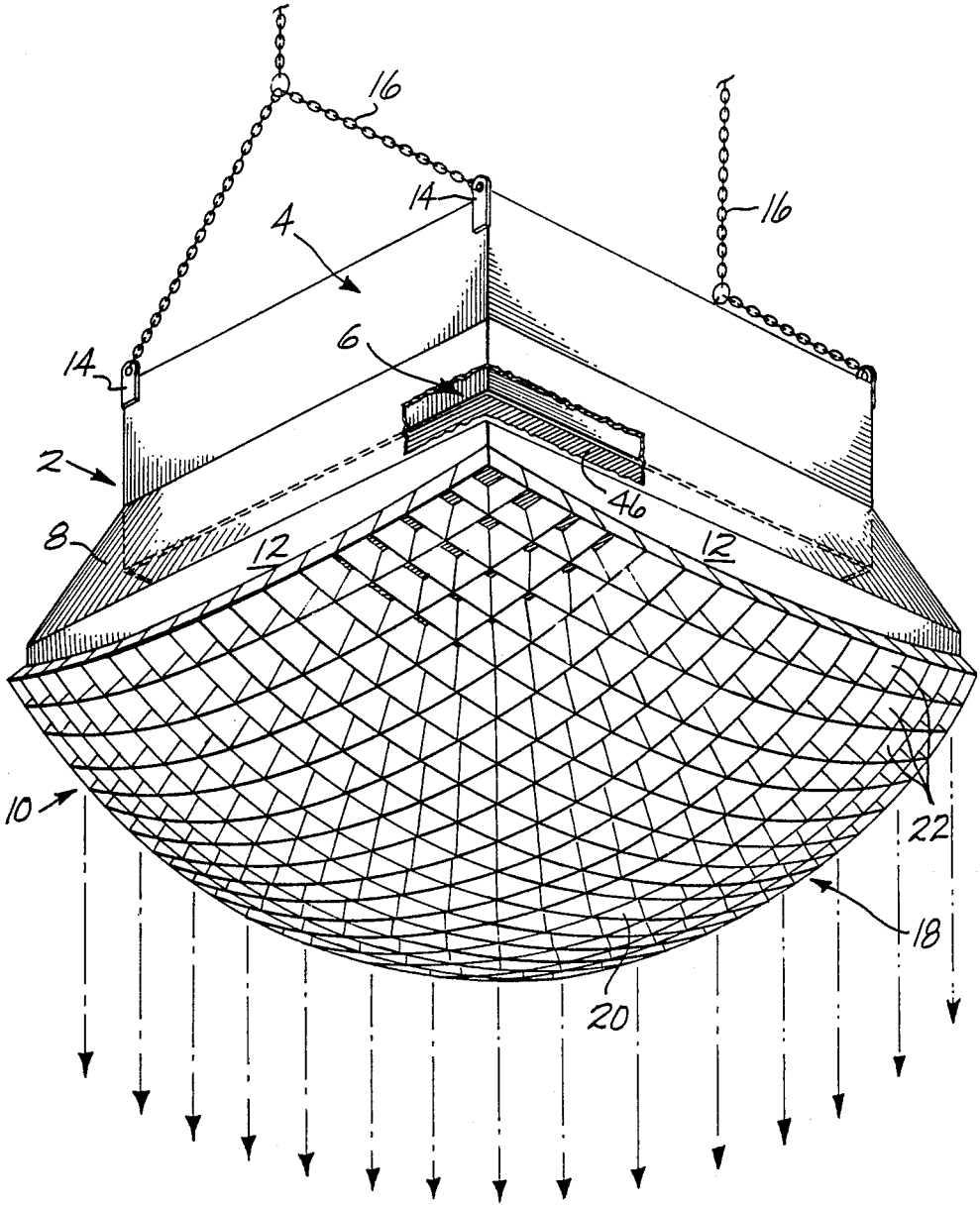
FIG. 1 is a part cut-a-way perspective view of an infrared overhead space heater equipped with an inventive panel at the bottom thereof.
Figure 5:
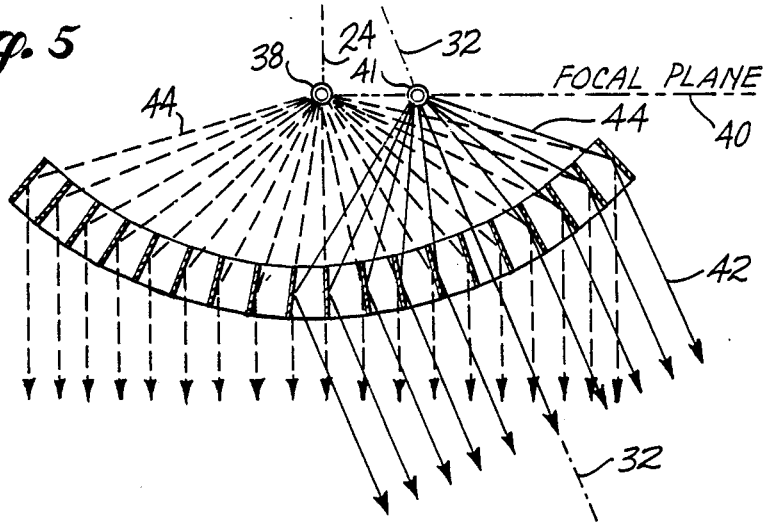
FIG. 5 is another such cross-sectional view of the panel, but illustrating the heat focusing effects of the same with respect to energy radiating from still further points above the panel.
Figure 6:
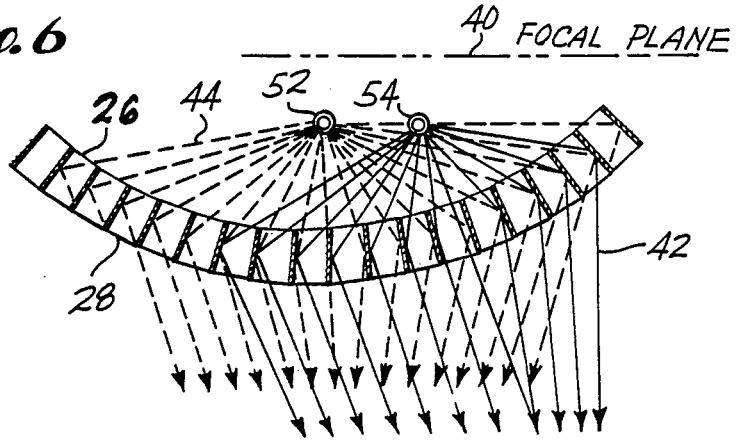
FIG. 6 is a fourth such view illustrating the heat focusing effects with respect to energy radiating from still other points above the panel.
Figure 7:
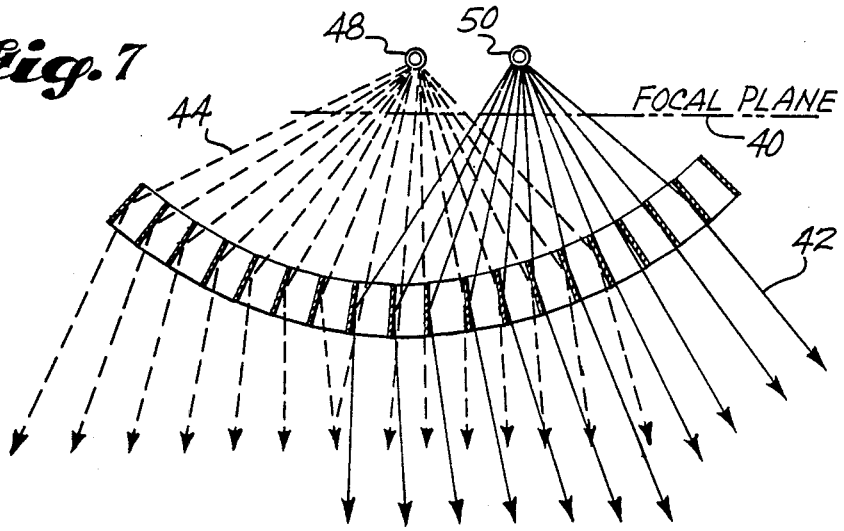
FIG. 7 is a fifth such view illustrating the heat focusing effects with respect to energy radiating from still further points above the panel.
Figure 9:
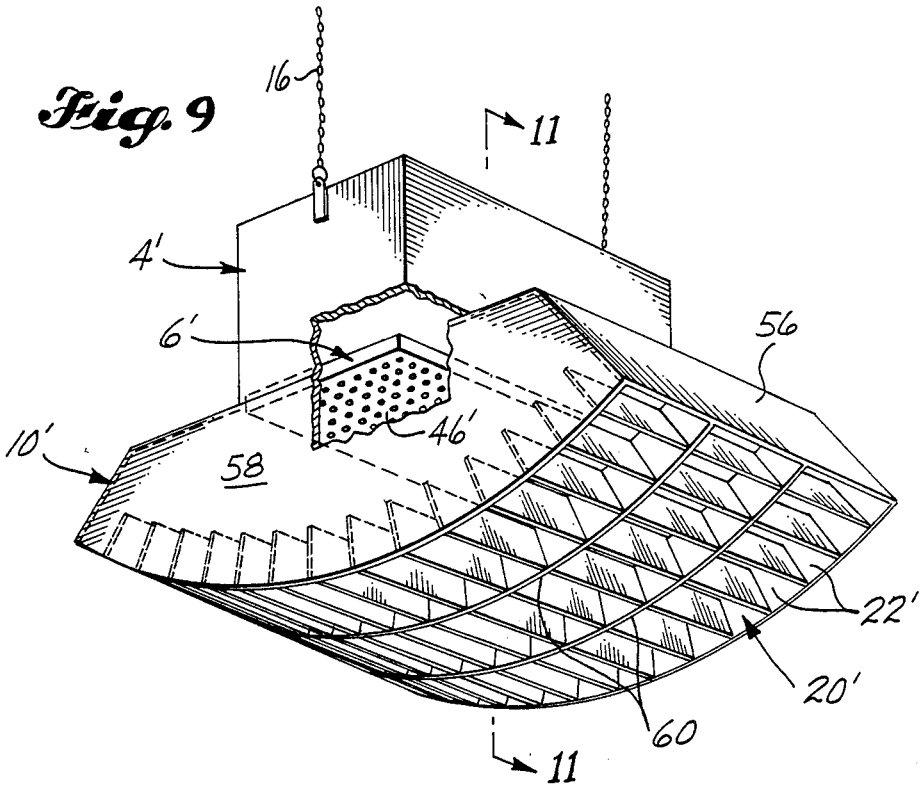
FIG. 9 is a part cut-a-way perspective view of an infrared overhead space heater equipped with a modified panel at the bottom thereof.
Figure 10:
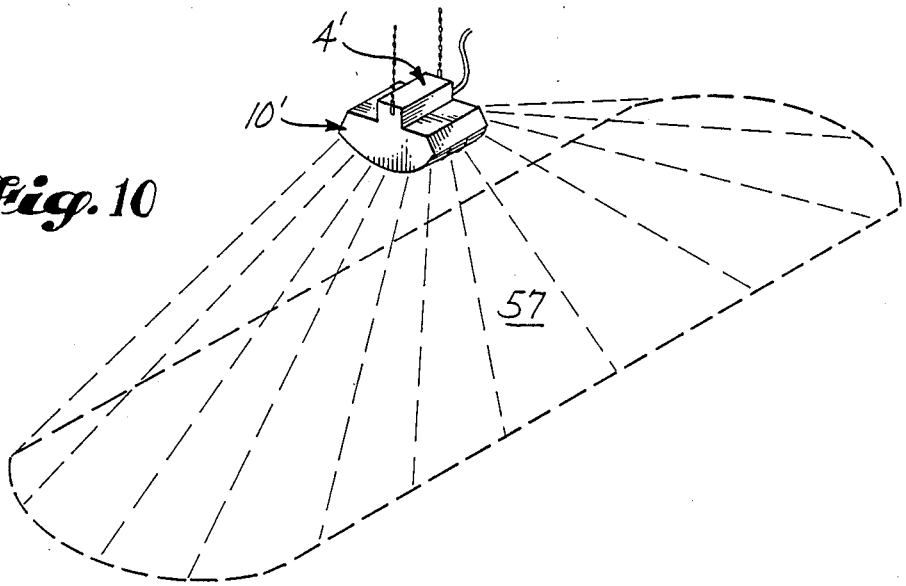
FIG. 10 is a schematic perspective view illustrating the heat focusing effects generated by the modified panel in FIG. 9.
Figure 11:
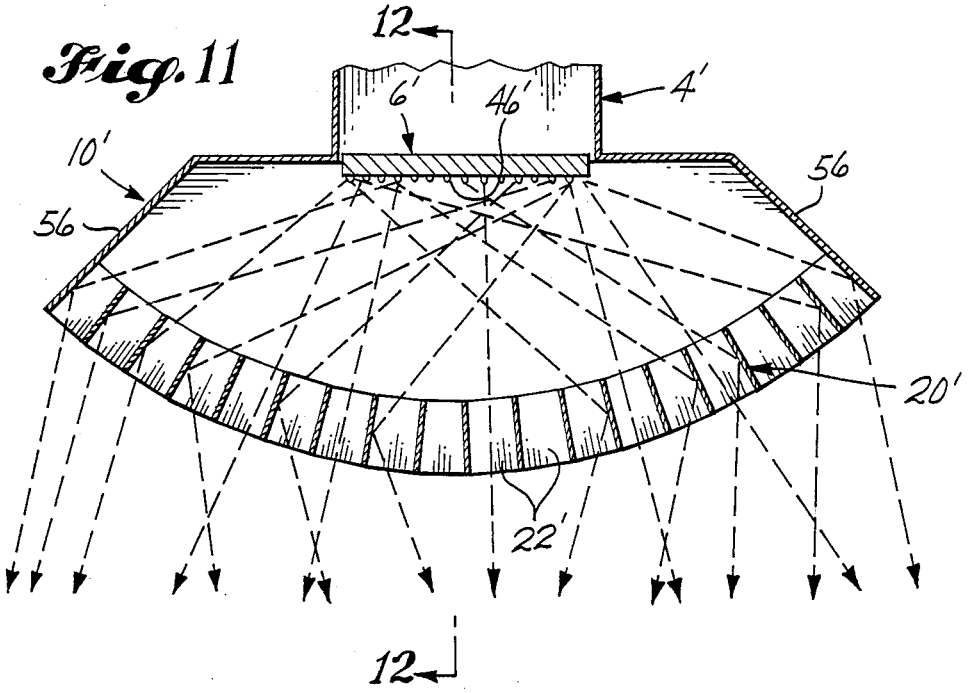
FIG. 11 is a part cross-sectional view of the heater in FIG. 9 along the line 11—11 thereof, illustrating heat focusing effects generated in the plane of the same.

Referring to the drawings, it will be seen that the heater 2 in FIGS. 1–8 comprises a suspended housing 4 having a flat-plate gas fired infrared radiation unit 6 enclosed therewith, and a part-trapizoidal reflector apron 8 depending therearound. The apron 8 in turn has an inventive control panel 10 affixed across the bottom opening thereof so that heat radiated downwardly of the housing is subject to the focusing effects of the panel. The housing 4 and radiation unit 6 are generally square in outline, and the apron 8 has a similarly shaped rim 12 about the bottom opening thereof to which the panel 10 is affixed. The panel itself is part-spherical in cross-section, however, so that the rim 12 and the outline of the panel meet along arcuate lines at the four sides of the heater.

The heater is commonly suspended by pairs of brackets 14 which are attached to chains 16 at the upper right and left hand corners of the housing.

Interiorly, the panel 10 comprises an aluminum grid structure 18, the thin webbed aluminum matrix 20 of which defines an array of open ended cells 22 that are juxtaposed to one another about the axis 24 of transmission (FIGS. 3–7), and open to the opposing sides of the panel at opposing axially oriented concavo-convex faces 26 and 28 thereof. The individual cells 22 of the array have reflective walls 30 about the inner peripheries thereof, and are orthogonal in cross-section in planes perpendicular to those axes 32 (FIG. 5) of the cells which extend in the general axial direction of the panel and outward through the open end portions 34 and 36 of the cells. Moreover, as seen in FIGS. 3–8, the latter mentioned axes 32 of the cells are angularly oriented to the axis 24 of transmission so that the panel has a focal point 38 on the upper side thereof, and the cells are varied in length along the respective axes 32 thereof, relative to the cross-sectional areas thereof, so that when the source 6 is disposed at the focal point, the energy which is radiated into the adjacent open upper end portions 34 of the cells from that point, undergoes reflection to and from the walls 30 of the cells no more than twice before exiting from the cells at the open bottom ends 36 thereof. In addition, the cells are so angularly oriented and sized as indicated, that the energy radiated into the same from the focal point 38, is reflected from the outer peripheral walls of the cells in the direction of the underside of the panel along parallels to the axis 24 of transmission at those points on the outer peripheral walls 30 of the cells where the centermost cross-sectional planes of the cells, axially thereof, intersect the aforesaid outer peripheral walls. See FIGS. 3 and 8 in particular. In fact, to the maximum extent possible, the cells are so angled and sized that energy radiating into the upper end portions 34 of the cells from the upper side of the panel, undergoes reflection no more than twice before exiting through the open bottom ends 36 of the cells. This assures that the rays 42 of outgoing reflected energy have the same angle to the axes 32 of the respective cells, as do the corresponding incoming incident rays 44 of energy.

Since there is a great multiplicity of cells in the panel, the cells can be given substantially square cross-sections in the aforesaid cross-sectional planes thereof, and the cross-section of each cell can be maintained substantially constant in area from one end of the cell to the other. That is, there need be no taper in the cells, which is the preferred way of fabricating them. However, if the panel were considerably smaller in size or had considerably fewer cells, it might be necessary to provide a slight axially inwardly inclined taper to the cells in the direction axially inward of the panel, or at least with respect to those cells which are peripherally outwardly disposed in the array, in order to fabricate the matrix from a webbing material which is uniform in thickness. Likewise, it might be necessary to provide a more rectangular cross-section in those cells disposed peripherally outwardly from the axis 24 of transmission.

Referring still further to FIGS. 3–7, it will be seen that when the radiation face 46 of the unit 6 is disposed in the focal plane 40 of the panel, all points of radiation in the face of the unit, including those points 41 spaced apart from the focal point 38, undergo a similar collineated pattern of transmission axially downwardly from the face. However, in the case of each off axis point 41, the collineation is with respect to the axis 32 of that cell whose axis intersects the face of the unit at the point of radiation, rather than with respect to the axis 24. See FIG. 5 in this regard. On the other hand, when the face 46 of the unit 6 is disposed out of the plane 40, for example, above the plane as in FIG. 7 and the schematic illustration on the left hand side of FIG. 4, then the radiation 48 undergoes a dispersing effect in the sense that the outgoing rays or lines 42 of reflected radiation tend to diverge from the axis which intersects the face of the unit, whether that axis be the axis 24 of transmission as in FIG. 4, or the cell axis 32 which intersects the face of the unit at some point 50 laterally offset from the axis 24, as in FIG. 7. Conversely, when the face 46 of the unit 6 is disposed below the focal plane 40, as in FIG. 6 and the schematic illustration on the right hand side of FIG. 4, then the radiation 52 undergoes a condensing effect in the sense that the outgoing rays or lines 42 of reflected radiation tend to converge on the axis in question, whether that axis be the axis 24 of transmission or the cell axis 32 which intersects the face of the unit at some point 54 laterally offset from the axis 24 of transmission, as in FIG. 6. Accordingly, by varying the location of the radiation face of the unit with respect to the focal plane of the panel, it is possible to vary the extent to which each unit of radiation undergoes superposition, that is, the extent to which each unit of radiation is imaged or "stacked" in the area to be heated, together with other units of radiation from the face of the radiation unit. This in turn, enables the designer to irradiate a specified work space in more or less intensified form than the radiation source itself would provide by direct transmission to that space. For example, given a particular BTU per square foot rating for the unit 6, and a particular area therebelow to be irradiated, the designer can determine not only the best shape and size for the panel, but also the spatial relationship between the panel and the face of the unit which will provide the best level of heat in the space to be heated. Furthermore, since the designer is able to concentrate more heat within the space in question than was possible with a conventional heater having the same BTU per square foot rating, he can space the heater further above the work space to generate a "sun effect" and eliminate the discomfort to personnel which occurs when the heater is disposed so close that they experience "swings" in temperature as they more in and out of its image.

A similar but opposite effect occurs in the eyes of crustaceans of the suborder Macrura, such as shrimp, crayfish and lobsters. They have compound mirrored lens at the outer peripheries of their eyes, which are similar in cross-section to that of panel 10. They operate to "stack" incoming light at points on the retina of the eyes of the crustaceans, so that the dim light which is commonly available to them in their natural habitat, is intensified for the purposes of their vision. Of course, the panel 10 uses this superposition effect to focus points of radiation on an area below the panel, whereas the lens of the eye of the crustacean uses it to intensify incoming light on the retina of the eye. However, in other applications of the invention, the panel 10 or its counterpart may be used to intensify bands of incoming energy on points similar to the radiation points 38, 41, 48, 50, 52 and 54 mentioned above, rather than vice versa, as in the case of the illustrated embodiment.

In still further embodiments of the invention, the webbing of the matrix 20 and/or the walls 30 of the cells are adapted to selectively absorb certain frequencies of energy while reflecting one or more others, so that only certain desired frequencies are reflected in the outgoing direction. Moreover, in other embodiments, the cells 22 are impregnated with a different medium than the ambient liquid gaseous or other medium surrounding the panel or the counterpart thereto. For example, they may be filled with plugs (not shown) of a refractive and/or selectively absorptive glasseous material which passes infrared radiation only, i.e., an infrared filter material.

The focusing effects of the panel may be relaxed or omitted in one or more planes of the axis of transmission, as illustrated in FIGS. 9–12 where certain numerals have been reused and primed to refer to elements which are common to both embodiments. The housing 4' and radiation unit 6' are rectangular in outline, and to illustrate the extreme situation wherein the focusing effects are limited to one plane of the axis of transmission, and planes parallel thereto, the panel 10' is part cylindrical in cross-section and disposed so that the axis thereof (not shown) is parallel to the longer dimension of the unit 6' and above the face 46' thereof to generate a condensing effect with respect to the width of the unit. See FIG. 11 wherein it will be seen that between the flanks 56 of the panel 10', the cells 22' of the matrix 20' are so sized and oriented as to cause the radiation to converge on the axes in the manner of FIG. 6.

Figure 12:
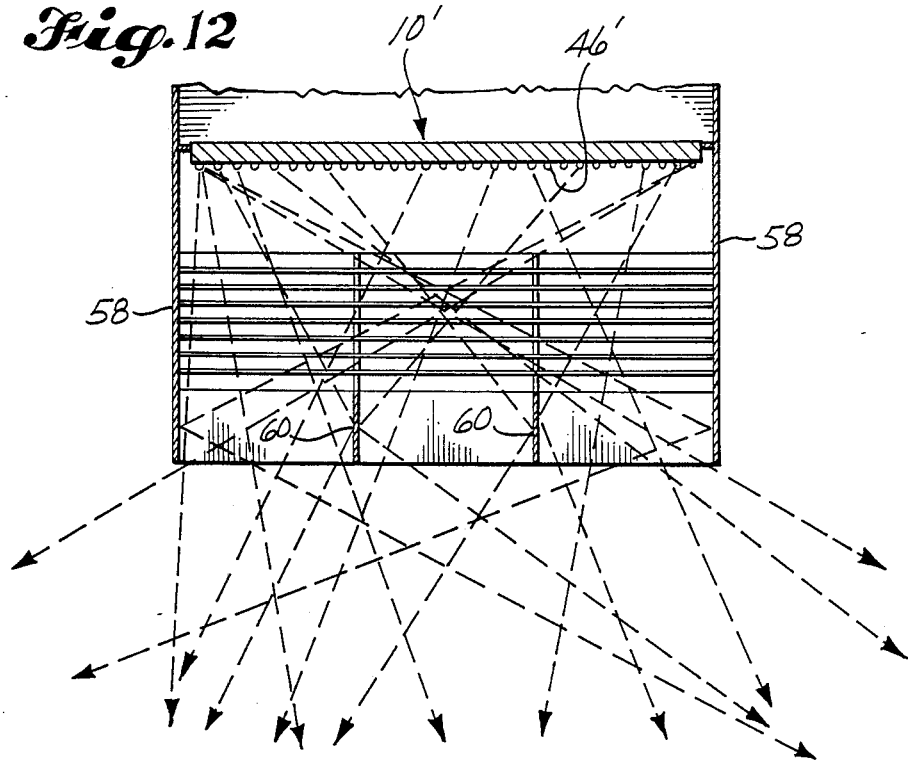
FIG. 12 is a part cross-sectional view of the latter heater along the line 12—12 of FIG. 11, illustrating the non-heat focusing, but confining effects generated in the plane of the latter line.

In the plane of the axis of the panel, that is, the plane of FIG. 12, the condensing effect has been relaxed or omitted altogether in that the cells 22' are rectangular in cross-section and the longer dimensions of the same are oriented along parallels to this plane so that the energy radiated from the bottom open ends of the cells is splayed along a line of the plane. The result is that the radiation is stacked in an area 57 which is more prolate or elliptical in plan view. See FIG. 10. This configuration may lend itself to heating a series of work stations in a shop.

To define the length of the line of radiation, the panel has straight parallel walls 58 at the axial ends thereof. The walls 58 are parallel to the axis of transmission, and preferably, are accompanied by one or more intermedite walls 60 between the ends of the panel, which impart strength to the panel. These are also parallel to the axis of transmission and symmetrically disposed between the end walls 58.

In further embodiments of the invention, the cells take the form of open ended slots in the plane of FIG. 12. That is, the walls 58 and 60 are omitted.

I claim:

1. In combination, a source of radiant energy, and means interposed on the axis of transmission between the radiant energy source and an area to be irradiated, to control the transmission of the radiant energy in the manner of a lens, said control means comprising a grid structure, the matrix of which defines an array of cells that are juxtaposed to one another about the axis of transmission, and have a pair of opposed radiant energy transmissive ends to the opposing sides of the structure at the opposing axially oriented faces thereof, the individual cells of the array having reflective walls about the inner peripheries thereof and being generally orthogonal in cross-section in planes perpendicular to those axes of the cells which extend in the general axial direction of the structure and outward through the radiant energy transmissive ends of the cells, the latter mentioned axes of the cells being angularly oriented to the axis of transmission so that the structure has a focal point on the axis of transmission at one side of the structure, and there being means including cells varying in length along the respective axes thereof, relative to the cross-sectional areas thereof, as the matrix progresses in directions radially outward from the axis of transmission so that when the source is shifted along the axis of transmission to one side or the other of the focal point, the energy is imaged on an area at the other side of the structure in a more or less intensified form than the source alone would provide by direct transmission to the area, depending on the location of the source with respect to the focal point.

2. Means for interposition on the axis of transmission between a radiant energy source and an area to be irradiated, to control the transmission of the radiant energy in the manner of a lens, said control means comprising a grid structure, the matrix of which defines an array of cells that are juxtaposed to one another about the axis of transmission, and have a pair of opposed radiant energy transmissive ends to the opposing sides of the structure at the opposing axially oriented faces thereof, the individual cells of the array having reflective walls about the inner peripheries thereof, and being generally orthogonal in cross-section in planes perpendicular to those axes of the cells which extend in the general axial direction of the structure and outward through the radiant energy transmissive ends of the cells, the latter mentioned axes of the cells being angularly oriented to the axis of transmission so that the structure has a focal point on the axis of transmisson at one side thereof, and the cells being varied in length along the respective axes thereof, relative to the cross-sectional areas thereof, as the matrix progresses in directions radially outward from the axis of transmission so that when the source is disposed at the focal point, the energy which is radiated into the adjacent radiant energy transmissive ends of the cells from that point, undergoes reflection to and from the walls of the cells no more than twice before exiting from the cells at the opposing radiant energy transmissive ends thereof, and is reflected from the outwardly positioned ones of the peripheral walls of the cells in the direction of the other side of the structure along substantial parallels to the axis of transmission, at those points on the aforesaid outward ones of the peripheral walls of the cells where the centermost cross-sectional planes of the cells, axially thereof, intersect the aforesaid outward ones of the peripheral walls.

3. The radiant energy transmission control means according to claim 2 wherein the cells have substantially square cross-sections in the aforesaid cross-sectional planes thereof, and the cross-sections are substantially constant in area from one end of each cell to the other.

4. The radiant energy transmission control means according to claim 2 wherein the cells are filled with the ambient medium about the structure.

5. The radiant energy transmission control means according to claim 2 wherein the cells are impregnated with a medium which is different from that surrounding the structure.

6. The radiant energy transmission control means according to claim 2 wherein the webbing of the matrix and/or the walls of the cells are adapted to selectively absorb certain frequencies of the energy while reflecting one or more others.

7. The radiant energy transmisson control means according to claim 2 wherein the faces of the structure are curved.

8. The radiant energy transmission control means according to claim 2 wherein the structure takes the form of a concavo-convexly faced panel of thin webbed matrix material.

9. The radiant energy transmission control means according to claim 2 wherein the cells have rectangular cross-sections in the aforesaid cross-sectional planes thereof, the longer dimensions of which are oriented along parallels to one plane of the axis of transmission so that the energy radiated from the aforesaid opposing radiant energy transmissive ends of the cells is splayed along a line of said one plane.

10. The radiant energy transmission control means according to claim 9 wherein the cells have opposing walls in the shorter dimensions thereof crosswise the aforesaid one plane of the axis of transmission, which are parallel to one another so that the radiated energy is splayed along a line of predetermined length.

11. A method of irradiating an area with radiant energy, comprising:

arranging a grid between a radiant energy source and the area to be irradiated, so that the cells in the matrix of the grid are juxtaposed to one another about the axis of transmission, and have a pair of opposed radiant energy transmissive ends to the opposing sides of the grid at the opposing axially oriented faces thereof;

the individual cells of the matrix having reflective walls about the inner peripheries thereof and being generally orthogonal in cross-section in planes perpendicular to those axes of the cells which extend in the general axial direction of the grid and outward through the radiant energy transmissive ends of the cells;

angularly orienting the latter mentioned axes of the cells to the axis of transmission;

varying the structural relationship of cells, one to another, as the matrix progresses radially outward from the axis of transmission, so that energy radiated from the source into the adjacent radiant energy transmissive ends of the cells, when the source is at the focal point of the grid, is reflected from the outwardly positioned ones of the peripheral walls of the cells in the direction of the other side of the grid along substantial parallels to the axis of transmission, the structural relationship of the cells being varied with respect to one another by varying the ratio between the lengths of the cells along the respective axes thereof and the cross-sectional areas of the cells perpendicular to the axes thereof; and positioning the source along the axis of transmission to one side or the other of the focal point of the grid, so that the energy imaged on the area at the other side of the grid, is imaged in more or less intensified form than the source alone would provide by direct transmission to the area, depending on the location of the source with respect to the focal point.

12. The method according to claim 11 wherein structural relationship of the cells is further varied with respect to one another by varying the angle the cells have to the axis of transmission.

13. The method according to claim 11 further comprising impregnating the cells with a medium which is different from that surrounding the grid.

14. The method according to claim 11 further comprising adapting the webbing of the matrix and/or the walls of the cells to selectively absorb certain frequencies of the energy while reflecting one or more others.

15. The method according to claim 11 wherein the cells have rectangular cross-sections in the aforesaid cross-sectional planes thereof, the longer dimensions of which are oriented along parallels to one plane of the axis of transmission so that the energy radiated from the aforesaid opposing radiant energy transmissive ends of the cells is splayed along a line of said one plane.

16. The method according to claim 11 wherein the faces of the grid are curved.

17. A method of irradiating an area with radiant energy, comprising:

arranging a grid between a radiant energy source and the area to be irradiated, so that the cells in the matrix of the grid are juxtaposed to one another about the axis of transmission, and have a pair of opposed radiant energy transmissive ends to the opposing sides of the grid at the opposing axially oriented faces thereof;

the individual cells of the matrix having reflective walls about the inner peripheries thereof and being generally orthogonal in cross-section in planes perpendicular to those axes of the cells which extend in the general axial direction of the grid and outward through the radiant energy transmissive ends of the cells;

angularly orienting the latter mentioned axes of the cells to the axis of transmission;

varying the structural relationship of cells, one to another, as the matrix progresses radially outward from the axis of transmission, so that energy radiated from the source into the adjacent radiant energy transmissive ends of the cells, when the source is at the focal point of the grid, is reflected from the outwardly positioned ones of the peripheral walls of the cells in the direction of the other side of the grid along substantial parallels to the axis of transmission, the structural relationship of the cells being varied with respect to one another by varying the angle the cells have to the axis of transmission, and the ratio between the lengths of the cells along the respective axes thereof and the cross-sectional area of the cells perpendicular to axes thereof; and positioning the source along the axis of transmission to one side or the other of the focal point of the grid, so that the energy imaged on the area at the other side of the grid, is imaged in more or less intensified form than the source alone would provide by direct transmission to the area, depending on the location of the source with respect to the focal point.

18. In combination, a source of radiant energy and a grid arranged on the axis of transmission between the radiant energy source and an area to be irradiated, to control the transmisson of the radiant energy in the manner of a lens, the matrix of said grid defining an array of cells that are juxtaposed to one another about the axis of transmission and have a pair of opposed radiant energy transmissive ends to the opposing sides of the grid at the opposing axially oriented faces thereof, the individual cells of the array having reflective walls about the inner peripheries thereof and being generally orthogonal in cross-section in planes perpendicular to those axes of the cells which extend in the general axial direction of the grid and outward through the radiant energy transmissive ends of the cells, the latter mentioned axes of the cells being angularly oriented to the axis of transmission, the structural relationship of cells varying, one to another, as the matrix progresses radially outward from the axis of transmission, so that energy radiated from the source into the adjacent radiant energy transmissive ends of the cells, when the source is at the focal point of the grid, is reflected from the outwardly positioned ones of the peripheral walls of the cells in the direction of the other side of the grid along substantial parallels to the axis of transmission, the structural relationship of the cells being varied with respect to one another in the ratio between the lengths of the cells along the respective axes thereof and the cross-sectional areas of the cells perpendicular to the axes thereof, and the source being positioned along the axis of transmission to one side or the other of the focal point of the grid, so that the energy is imaged on the area at the other side of the grid in a more or less intensified form than the source alone would provide by direct transmission to the area, depending on the location of the source with respect to the focal point.

19. The combination according to claim 18 wherein the structural relationship of the cells further varies with respect to one another in the angle the cells have to the axis of transmission.

20. The combination according to claim 18 wherein the cells are impregnated with a medium which is different from that surrounding the grid.

21. The combination according to claim 18 wherein the webbing of the matrix and/or the walls of the cells are adapted to selectively absorb certain frequencies of the energy while reflecting one or more others.

22. The combination according to claim 18 wherein the cells have rectangular cross-sections in the aforesaid cross-sectional planes thereof, the longer dimensions of which are oriented along parallels to one plane of the axis of transmission so that the energy radiated from the aforesaid opposing radiant energy transmissive ends of the cells is splayed along a line of said one plane.

23. The combination according to claim 18 wherein the faces of the grid are curved.

24. In combination, a source of radiant energy and a grid arranged on the axis of transmission between the radiant energy source and an area to be irradiated, to control the transmission of the radiant energy in the manner of a lens, the matrix of said grid defining an array of cells that are juxtaposed to one another about the axis of transmission and have a pair of opposed radiant energy transmissive ends to the opposing sides of the grid at the opposing axially oriented faces thereof, the individual cells of the array having reflective walls about the inner peripheries thereof and being generally orthogonal in cross-section in planes perpendicular to those axes of the cells which extend in the general axial direction of the grid and outward through the radiant energy transmissive ends of the cells, the latter mentioned axes of the cells being angularly oriented to the axis of transmission, the structural relationship of cells varying, one to another, as the matrix progresses radially outward from the axis of transmission, so that energy radiated from the source into the adjacent radiant energy transmissive ends of the cells, when the source is at the focal point of the grid, is reflected from the outwardly positioned ones of the peripheral walls of the cells in the direction of the other side of the grid along substantial parallels to the axis of transmission, the structural relationship of the cells being varied with respect to one another in the ratio between the lengths of the cells along the respective axes thereof and the cross-sectional areas of the cells perpendicular to the axes thereof, and the source being positioned along the axis of transmission to one side or the other of the focal point of the grid, so that the energy is imaged on the area at the other side of the grid in a more or less intensified form than the source alone would provide by direct transmission to the area, depending on the location of the source with respect to the focal point.

25. A grid for arranging on the axis of transmission between a radiant energy source and an area to be irradiated, to control the transmission of the radiant energy in the manner of a lens, the matrix of said grid defining an array of cells that are juxtaposed to one another about the axis of transmission and have a pair of opposed radiant energy transmissive ends to the opposing sides of the grid at the opposing axially oriented faces thereof the individual cells of the array having reflective walls about the inner peripheries thereof and being generally orthogonal in cross-section in planes perpendicular to those axes of the cells which extend in the general axial direction of the grid and outward through the radiant energy transmissive ends of the cells.

the latter mentioned axes of the cells being oriented to the axis of transmission, and the structural relationship of cells varying, one to another, as the matrix progresses radially outward from the axis of transmission, so that when the source is at the focal point of the grid, energy radiated from the source into the adjacent radiant energy transmissive ends of the cells, is reflected from the outwardly positioned ones of the peripheral walls of the cells in the direction of the other side of the grid along parallels to the axis of transmission, the structural relationship of the cells being varied with respect to one another in the ratio between the lengths of the cells along the respective axes thereof and the cross-sectional areas of the cells perpendicular to the axes thereof, thereby enabling the energy to be imaged on the area at the other side of the grid in a more or less intensified form than the source alone would provide by direct transmission to the area, by positioning the source along the axis of transmission to one side or the other of the focal point of the grid.

26. The grid according to claim 25 wherein when the source is disposed at the focal point, the energy which is radiated into the adjacent radiant energy transmissive ends of the cells from that point, undergoes reflection to and from the walls of the cells no more than twice before exiting from the cells at the opposing radiant energy transmissive ends thereof.

27. The grid according to claim 25 wherein the cells have substantially square cross-sections in the aforesaid cross-sectional planes thereof, and the cross-sections are substantially constant in area from one end of each cell to the other.

28. The grid according to 25 wherein the structural relationship of the cells further varies with respect to one another in the angle the cells have to the axis of transmission.

29. A grid for arranging on the axis of transmission between a radiant energy source and an area to be irradiated, to control the transmission of the radiant energy in the manner of a lens, the matrix of said grid defining an array of cells that are juxtaposed to one another about the axis of transmission and have a pair of opposed radiant energy transmissive ends to the opposing sides of the grid at the opposing axially oriented faces thereof the individual cells of the array having reflective walls about the inner peripheries thereof and being generally orthogonal in cross-section in planes perpendicular to those axes of the cells which extend in the general axial direction of the grid and outward through the radiant energy transmissive ends of the cells, the latter mentioned axes of the cells being oriented to the axis of transmission, and the structural relationship of cells varying, one to another, as the matrix progresses radially outward from the axis of transmission, so that when the source is at the focal point of the grid, energy radiated from the source into the adjacent radiant energy transmissive ends of the cells, is reflected from the outwardly positioned ones of the peripheral walls of the cells in the direction of the other side of the grid along parallels to the axis of transmission, the structural relationship of the cells being varied with respect to one another in the angle the cells have to the axis of transmission and the ratio between the lengths of the cells along the respective axes thereof and the cross-sectional areas of the cells perpendicular to the axes thereof, thereby enabling the energy to be imaged on the area at the other side of the grid in a more or less intensified form than the source alone would provide by direct transmission to the area, by positioning the source along the axis of transmission to one side or the other of the focal point of the grid.

* * * * *